US010783835B2

(12) United States Patent
Luna et al.

(10) Patent No.: US 10,783,835 B2
(45) Date of Patent: Sep. 22, 2020

(54) AUTOMATIC CONTROL OF DISPLAY BRIGHTNESS

(71) Applicant: Lenovo (Singapore) Pte. Ltd., Singapore (SG)

(72) Inventors: Joaquin F. Luna, Durham, NC (US); Russell Speight VanBlon, Raleigh, NC (US); Scott Wentao Li, Cary, NC (US); Robert James Kapinos, Durham, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 40 days.

(21) Appl. No.: 15/068,125

(22) Filed: Mar. 11, 2016

(65) Prior Publication Data

US 2017/0263192 A1 Sep. 14, 2017

(51) Int. Cl.
*G09G 3/34* (2006.01)

(52) U.S. Cl.
CPC ... *G09G 3/3406* (2013.01); *G09G 2320/0626* (2013.01); *G09G 2354/00* (2013.01); *G09G 2360/144* (2013.01); *G09G 2360/145* (2013.01); *G09G 2360/16* (2013.01)

(58) Field of Classification Search
CPC ..... G09G 2320/0626; G09G 2360/144; G09G 3/3406; G09G 2354/00; G09G 2360/145; G09G 2360/16; G09G 5/003
See application file for complete search history.

(56) References Cited

U.S. PATENT DOCUMENTS 5,563,670 A * 10/1996 Tenmyo ..... A61B 3/103 351/211
5,617,112 A * 4/1997 Yoshida ..... G09G 3/22 345/102
7,744,216 B1 * 6/2010 Uhlhorn ..... G06K 9/00604 351/204
8,068,125 B2 * 11/2011 Pantfoerder ..... G09G 3/20 345/690
8,319,804 B2 * 11/2012 Kuo ..... G06F 1/1637 345/174
8,384,002 B2 * 2/2013 Holladay ..... A61F 2/1618 250/201.2
8,537,174 B2 * 9/2013 Capener ..... G09G 5/10 345/589
8,552,850 B2 * 10/2013 De Mers ..... A61B 5/163 340/439
8,767,306 B1 * 7/2014 Miao ..... G02B 27/0172 359/629
9,101,279 B2 * 8/2015 Ritchey ..... G16H 40/63
9,170,646 B2 * 10/2015 Toner ..... G06F 3/016
9,261,713 B1 * 2/2016 Weksler ..... G02C 7/101
9,390,682 B2 * 7/2016 Hadas ..... G09G 5/10
9,530,051 B2 * 12/2016 Huang ..... H04N 5/2354
9,613,592 B2 * 4/2017 Kobayashi ..... G02B 27/017
9,754,555 B2 * 9/2017 Wu ..... G09G 5/10

(Continued)

*Primary Examiner* — Michael J Jansen, II
(74) *Attorney, Agent, or Firm* — Ference & Associates LLC

(57) ABSTRACT

One embodiment provides a method including: capturing, using a camera on a device, at least one image of a user viewing a display of the device; and adjusting, using a processor, a brightness setting of the display from a first setting to a second setting based on the at least one image. Other aspects are described and claimed.

16 Claims, 4 Drawing Sheets

(56) References Cited

U.S. PATENT DOCUMENTS 9,844,119 B2 * 12/2017 Mullins ..... H05B 37/0218
10,019,925 B2 * 7/2018 Wu ..... G09G 3/2003
10,230,938 B2 * 3/2019 Kura ..... G02B 27/0172
2008/0165203 A1 * 7/2008 Pantfoerder ..... G06F 3/0416 345/589
2010/0321482 A1 * 12/2010 Cleveland ..... H04N 5/23296 348/78
2011/0080421 A1 * 4/2011 Capener ..... G09G 5/10 345/589
2011/0181541 A1 * 7/2011 Kuo ..... G06F 1/1637 345/174
2011/0199202 A1 * 8/2011 De Mers ..... A61B 5/163 340/439
2011/0213462 A1 * 9/2011 Holladay ..... A61F 2/1618 351/159.41
2012/0113209 A1 * 5/2012 Ritchey ..... G02B 27/0179 348/14.02
2012/0133754 A1 * 5/2012 Lee ..... H04N 21/485 348/78
2013/0125027 A1 * 5/2013 Abovitz ..... G06F 3/016 715/757
2013/0336631 A1 * 12/2013 Kura ..... H04N 13/30 386/230
2014/0022371 A1 * 1/2014 Huang ..... H04N 7/18 348/78
2014/0111632 A1 * 4/2014 Huang ..... G06F 3/013 348/78
2015/0254508 A1 * 9/2015 Kimura ..... G06K 9/00604 382/117
2015/0269907 A1 * 9/2015 Hadas ..... G09G 5/363 345/589
2016/0034032 A1 * 2/2016 Jeong ..... G06T 19/006 345/156
2016/0063909 A1 * 3/2016 Zhang ..... G09G 3/2003 345/589
2016/0104454 A1 * 4/2016 Huang ..... G09G 5/10 345/156
2016/0231573 A1 * 8/2016 Mullins ..... H05B 37/0218
2016/0266643 A1 * 9/2016 Martensson ..... G09G 3/20
2016/0322026 A1 * 11/2016 Kobayashi ..... G06F 3/03547
2017/0039919 A1 * 2/2017 Wu ..... G09G 5/10
2017/0039994 A1 * 2/2017 Wu ..... G09G 5/10
2017/0047046 A1 * 2/2017 Tam ..... H04N 21/4854
2017/0206860 A1 * 7/2017 Wu ..... G09G 5/10
2017/0263192 A1 * 9/2017 Luna ..... G09G 3/3406
2018/0315365 A1 * 11/2018 Wu ..... G09G 5/10

* cited by examiner

AUTOMATIC CONTROL OF DISPLAY BRIGHTNESS

BACKGROUND

The prevalence and portability of information handling devices (e.g., smart phones, tablets, personal computers, laptop computers, etc.) allow users to use these devices to provide and accept input in a variety of locations. One way that users may interact with and receive information from a device is through the device's display. In order to properly visualize the content being portrayed on the display, the ideal brightness of the display must be set based on the environment in which it is being viewed. For example, in areas with an abundance of available light the display must be brighter to remain visible. Conversely, in a dark room the display should be relatively dim to avoid an uncomfortable glare experienced by the user.

Ambient light sensors (ALS) are often incorporated into information handling devices to measure how much light falls on the device. The device then automatically adjust the brightness of the display based upon the amount of light detected. However, ALS do not account for a user's sensitivity to light, which varies for each individual. Therefore, it would be desirable if a device better imitated the sensitivity of a user's eyes to more effectively adjust the brightness of the display.

BRIEF SUMMARY

In summary, one aspect provides a method, comprising: capturing, using a camera on a device, at least one image of a user viewing a display of the device; and adjusting, using a processor, a brightness setting of the display from a first setting to a second setting based on the at least one image.

Another aspect provides an electronic device, comprising: a camera; a processor; a memory device that stores instructions executable by the processor to: capture, using the camera, at least one image of a user viewing a display of the device; and adjust a brightness setting of the display from a first setting to a second setting based on the at least one image.

A further aspect provides a product, comprising: a storage device that stores code executable by a processor, the code comprising: code that captures, using a camera on a device, at least one image of a user viewing a display of the device; and code that adjusts, using a processor, a brightness setting of the display from a first setting to a second setting based on the at least one image.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
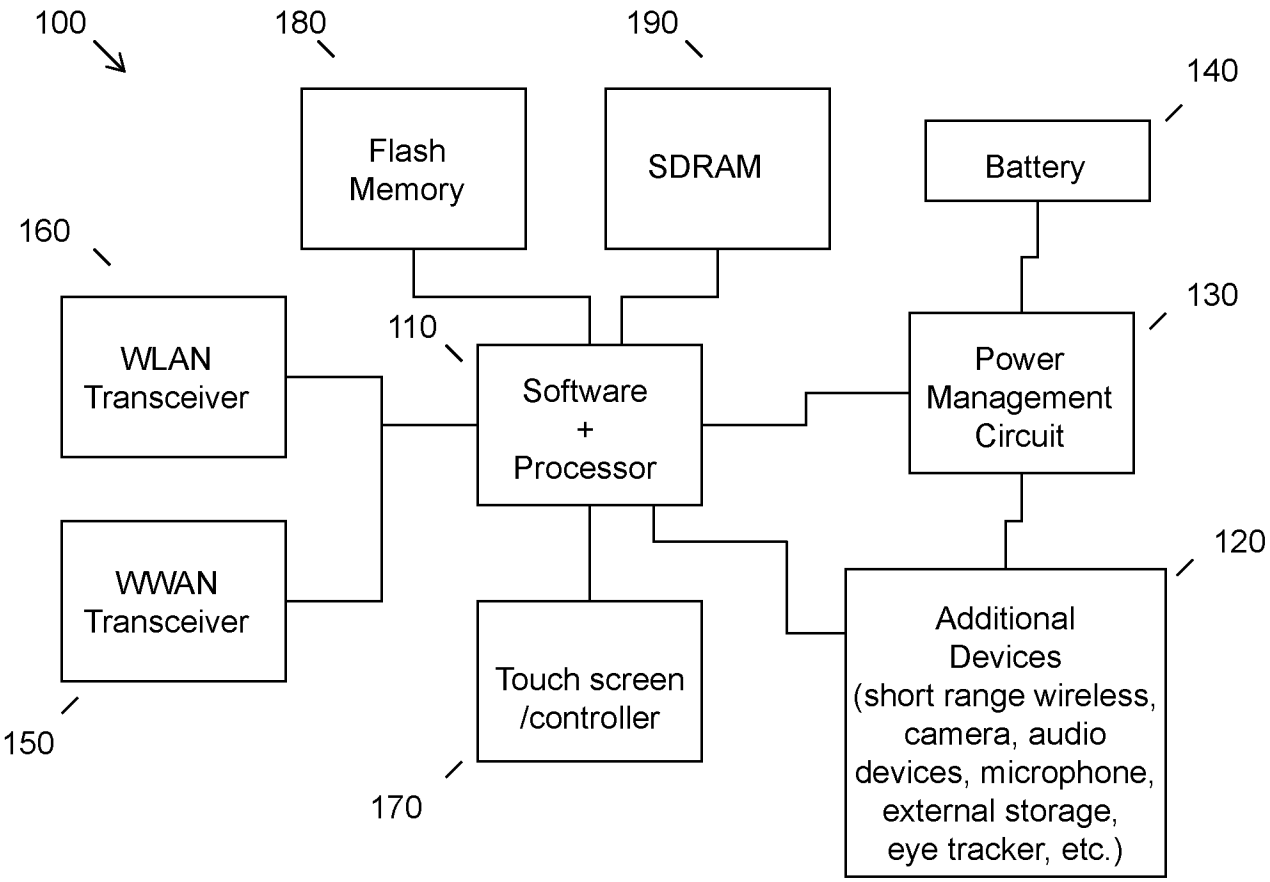
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

The ideal brightness of a display of an information handling device (e.g., smart phone, tablet, personal computer, laptop computer, etc., herein "device") should be set based on the environment in which it is being viewed. In areas with an abundance of light (e.g., outdoors on a sunny day), the display must be brighter to remain visible. Conversely, in darker areas (e.g., indoors in a dark room), the display should be relatively dim so that it does not aggravate a user's eyes.

One current method to assist in improved display visibility is for a user to manually adjust the brightness settings on their device. These settings can be accessed from various locations on the device (e.g., the home screen) and may be adjusted to increase or decrease the brightness of the display. However, it is sometimes difficult to reach these settings because a user may already be in an environment that makes viewing the display difficult. In addition, it is inconvenient for users who frequently traverse between bright and dark environments to constantly have to adjust these settings.

These technical issues present difficulties for users in that constantly adjusting the brightness of a display may be difficult and burdensome. A conventional solution is to incorporate into the device one or more ambient light sensor(s) (ALS). An ALS detects the amount of light in the environment and may be used wherever the settings of a system need to be adjusted to the ambient light conditions as perceived by users. For example, an ALS is used to maintain the same display appearance in LCD screens on devices under all light conditions. When an increasing amount of light falls on the ALS, the device's display correspondingly becomes brighter to provide the user with an improved ability to view the content on the display. Conversely, when there is less light in the surrounding environment, the display dims so the brightness from the display does not aggravate a user's eyes. However, an ALS incorporated into devices does not account for a user's sensitivity to light, which varies for each individual. In addition, devices containing an ALS have difficulty in extremely bright or dark environments. For example, when outdoors on a sunny day, a user's eye may adjust to the very bright surroundings, but a device placed in the shade may not choose a bright enough setting because only a modest amount of light will fall on the ALS. In another example, in a very dark room a device's display will be the brightest object in the room so the feedback from the display that falls on the ALS may cause the display to be brighter than necessary.

Accordingly, an embodiment provides a method for automatically adjusting the brightness of a display based upon a user's pupillary dilation. In an embodiment, a forward (user) facing camera on a device may be used to capture an image of a user's eye, which may then be analyzed to measure the width of the user's pupil. The brightness of the display may then automatically be adjusted to an ideal brightness setting that corresponds with the measured pupil width or other relevant dimension related to a user's sensitivity to display screen brightness. In an embodiment, an individual user's sensitivity to light may be measured by correlating a measure of the pupillary response with ambient light measurements from the environment.

The illustrated example embodiments will be best understood by reference to the figures. The following description is intended only by way of example, and simply illustrates certain example embodiments.

While various other circuits, circuitry or components may be utilized in devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additional devices 120 are commonly included. In an embodiment, a camera or other sensor may be included as an additional device 120, e.g., for imaging a user in connection with measuring eye dimensions related to display brightness, as further described herein. System 100 often includes a touch screen or touch surface 170 for data input and display/rendering. System 100 also typically includes various memory devices, for example flash memory 180 and SDRAM 190.

Figure 2:
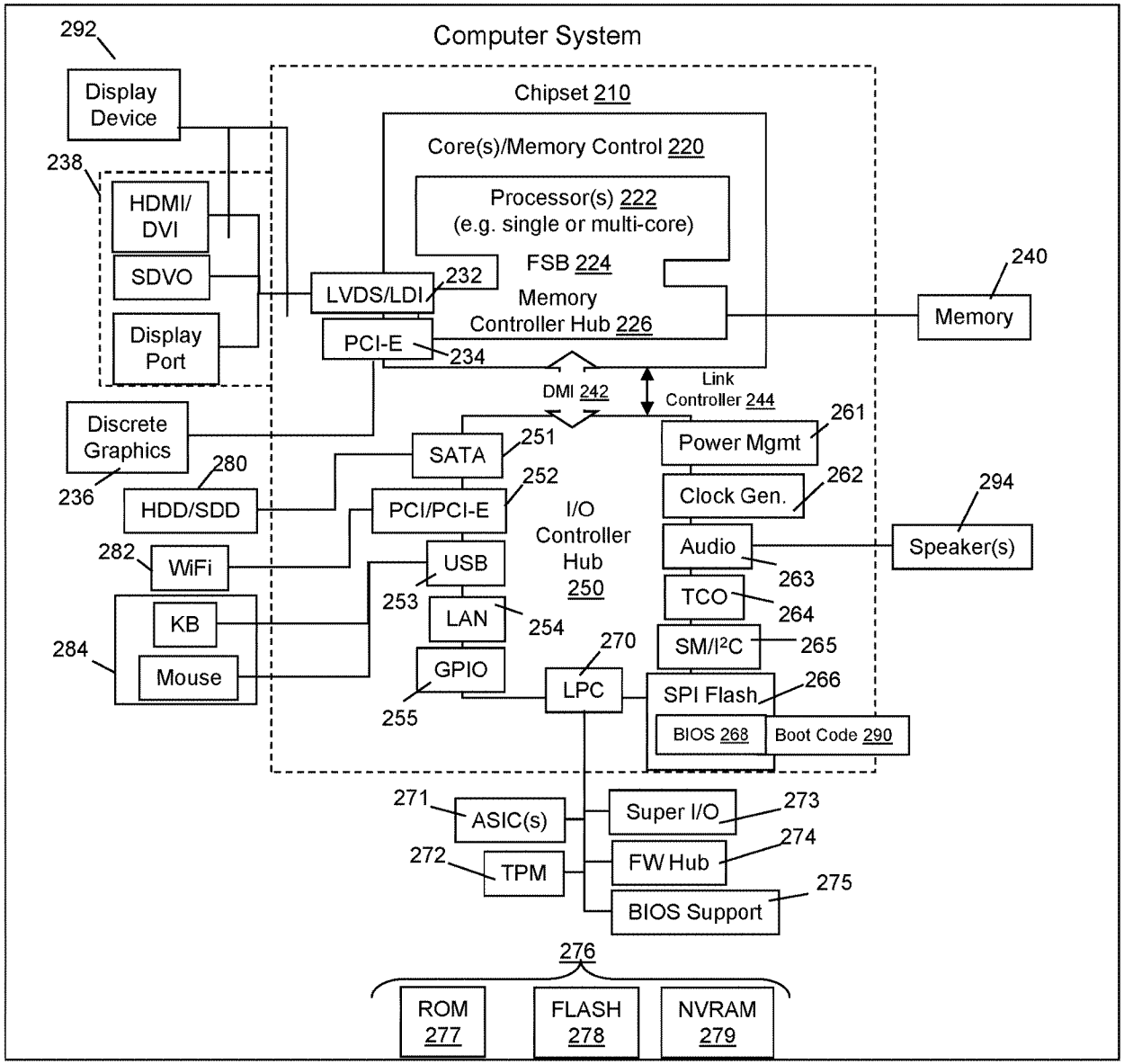
FIG. 2 illustrates another example of information handling device circuitry.

FIG. 2 depicts a block diagram of another example of device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Device circuitry, as for example outlined in FIG. 1 or FIG. 2, may be used in devices that such as tablets, smart phones, personal computer devices generally, and/or other mobile electronic devices which users may use to visualize content on a display. For example, the circuitry outlined in FIG. 1 may be implemented in a tablet or smart phone embodiment, whereas the circuitry outlined in FIG. 2 may be implemented in a personal computer embodiment, e.g., a laptop personal computer.

Figure 3:
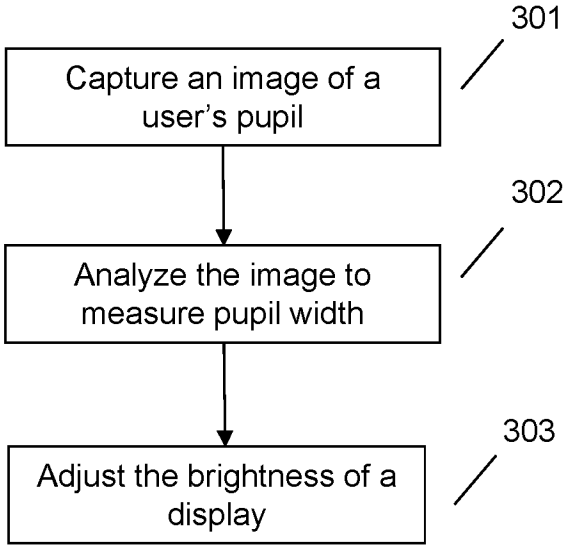
FIG. 3 illustrates an example method of automatically controlling the brightness of a display.

Referring now to FIG. 3, at 301, an embodiment may capture an image of a user. The image of the user may be used to analyze the user's sensitivity to light and thus adjust the brightness of the display screen. For example, the image of the user may be processed to determine the dimension (e.g., width) of the user's pupil(s).

In an embodiment, a forward facing camera may be utilized. In an embodiment, the camera may be a light based-camera (e.g., an RGB camera). Light-based cameras may be used in environments that contain an amount of visible light (e.g., light with a wavelength in the 400-700 nm range). These types of cameras utilize the visible light to accurately capture the details of an image.

In darker ambient light environments, light based and ambient light cameras are not as effective because there is a scarcity of visible light. Additionally, RGB cameras perform poorly in brighter environments (e.g., outdoors on a sunny day) when the device is in shadow because they are unable to attain a good visual on the user because the user will appear very dark in contrast to the bright environment. In an embodiment, under low light conditions, the camera may be an infrared (IR) camera. An IR camera is a device that forms an image using IR radiation, which is emitted by all objects based on their temperatures. An IR camera may operate in very long wavelengths (e.g., up to 14,000 nm) which makes it possible for these cameras to accurately capture an image with or without visible illumination.

In an embodiment, alternative depth camera type arrangements may be utilized. In an embodiment, cameras having an active emitter (e.g., laser or IR emitter) may be used to capture an image in total darkness. In an embodiment, cameras having a very long exposure time may also be utilized because they work well in low light conditions. By leaving a camera's shutter open for an extended period of time, more light is absorbed, creating an exposure that captures the entire range of the digital camera sensor. In an embodiment, a variety of different types of cameras or sensors may also be utilized including, but not limited to, laser painting and specialized low-light sensors (e.g., back-illuminated sensors), which increase the amount of light captured and thereby improve low-light performance. In an embodiment, if there is more than one type of sensor or camera on board a device, the device may switch between the different types of sensors to use the sensor that would produce the most ideal image in a particular environment.

In an embodiment, the frequency of picture capture for pupil measurement may be adjusted. For example, in an embodiment, an image may be taken every three seconds. As another example, multiple images may be taken each second. In an embodiment, the frequency of image capture may be adjusted, e.g., by the user or automatically according to a policy or programmed adjustment. In an embodiment, the frequency of image capture may be dynamically adjusted based upon data received from the ALS. For example, when data associated with the ALS indicates that the device has been moved to a brighter environment, the camera may be prompted to take an image of the user's pupil in this new environment.

At 302, an embodiment may analyze the captured image to measure the width of the pupil. Rather than, or in addition to, measuring the amount of light that falls on the device's sensor, an embodiment may measure a user's biological response to the amount of light entering the eyes. In an embodiment, systems that include gaze detection and facial recognition may be used to perform the pupil measurement.

At 303, an embodiment may adjust the brightness of the display based on the pupil measurement. In an embodiment, the brightness of the display may be adjusted by reference to a pupil size, for example as stored in a data table. After the size of a pupil is measured, the measurement may be cross-referenced with a data table that contains predetermined, corresponding brightness settings for each measured pupil size. The display may be automatically adjusted to the brightness setting that corresponds to the measured pupil size. For example, when the size of a pupil is measured to be X mm wide, the brightness of the display is set to Y nits. The data table may be stored on the device, in the cloud, may be accessed online, etc.

In an embodiment, the brightness of the display may be adjusted based on an individual user's needs. As individuals age, muscles that control pupil size and reaction to light lose strength. This causes the pupils to become less responsive to changes in ambient lighting. Because of these changes, more ambient light is required to adequately perceive a particular object. For example, it is estimated that an individual in their advanced age needs as much as three times more ambient light for comfortable reading than a younger individual. Additionally, due to the sluggish response the pupils have to changes in light, certain individuals have increased difficulty when passing from a brightly lit environment to a darker one, and vice versa. For example, certain individuals are more likely to be dazed by bright sunlight and glare when emerging from a dimly lit building (e.g., a movie theater) because the dilated pupils require additional time to adjust to the new environment.

An embodiment may correlate a measure of the pupillary response with ambient light measurements from the environment to measure an individual user's sensitivity to light. In an embodiment, when new environmental light data is received by an ALS, a camera may be prompted to capture an image of the user's pupil(s) to determine pupil width. For example, if a user passes from a dark environment to a lighter environment (e.g., from a dimly lit movie theater to a bright outdoor environment), light data received by the ALS may prompt a camera to take an image of the user's pupil(s) in this new environment. Obtaining such personalized information assists in determining the optimal brightness control of the display. For example, using this measure, more accurate brightness settings may be achieved for all users in all conditions. Additionally, the rate at which the display screen brightness is adjusted may be changed based on a personalized setting. For example, a first user may have quick reaction to changing light, whereas a second user may have a slower response. Thus, an embodiment may tune the rate at which the display brightness is modified for the first and second user different.

Figure 4:
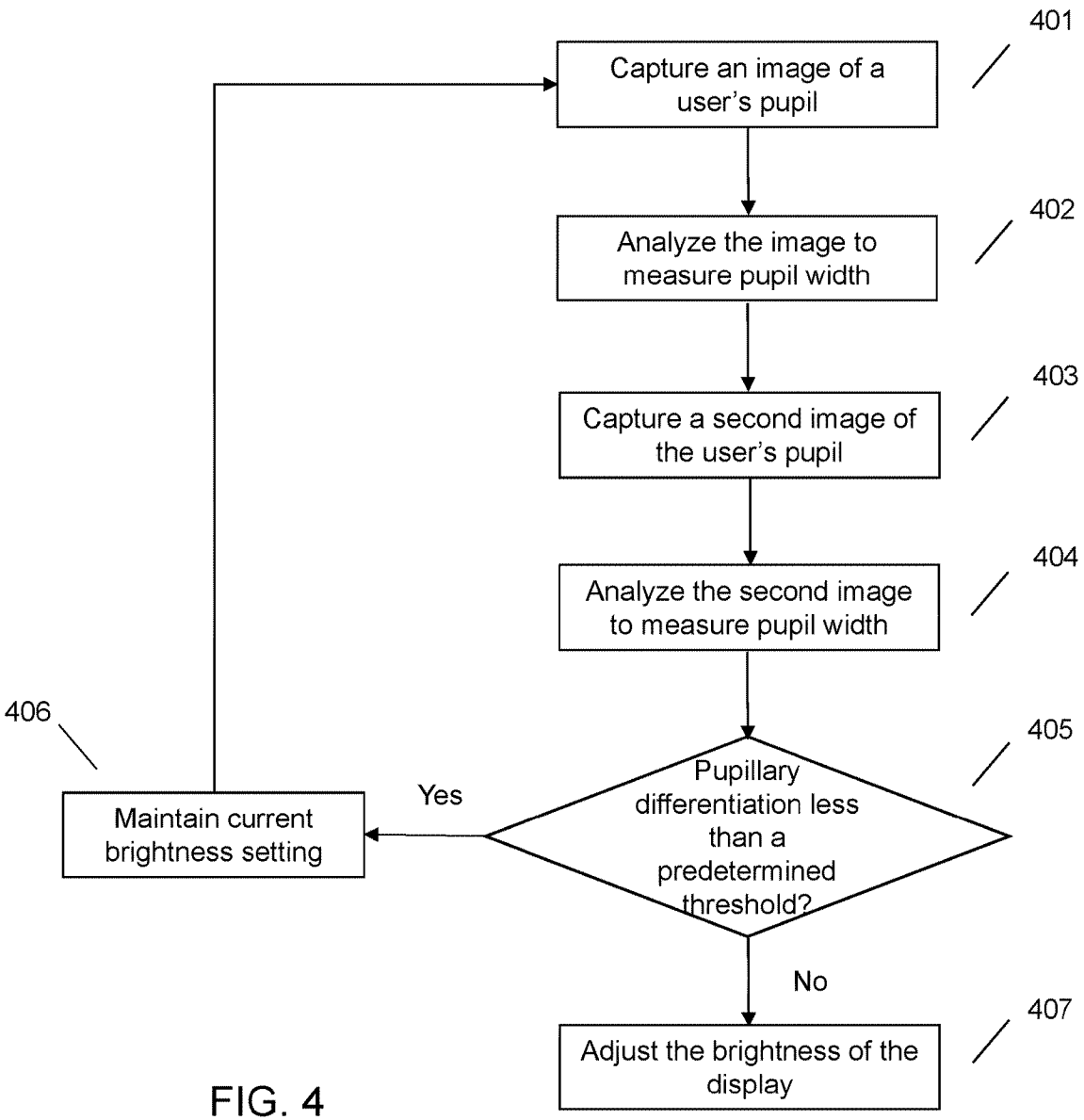
FIG. 4 illustrates an additional example method of automatically controlling the brightness of a display.

In an embodiment, the brightness of the display may be adjusted after each instance of pupil size measurement. Referring now to FIG. 4, in an embodiment, there may be a connection between pupil size measurement and display brightness adjustment. At 401, an embodiment may capture a first image of a user, e.g., with a camera. At 402, an embodiment may analyze that first image, e.g., with a processor, to determine the width of the user's pupil. At 403, an embodiment may capture a second image of a user, at a time after the first image. At 404, an embodiment may analyze that second image to determine the width of the user's pupil at the time that the second image was captured. At 405, the pupillary differentiation (i.e. difference in pupil size measurement between the first image and the second image) is examined. If the difference between the pupil sizes are determined to be insignificant, then an embodiment, at 406, may maintain the current brightness setting on the device. For example, in an embodiment, if the size of a user's pupil does not change by a significant width (e.g., 0.1-0.2 mm), or by a significant percentage (1-2 percent), between instances of image capture, then the brightness of the display is maintained at its current setting. As another example, if the projected display brightness differential between instances of image capture is projected to be insignificant (e.g., 1-2 nits), the brightness of the display is not adjusted. Not adjusting the brightness of the display unless there is a significant change in pupil size may help preserve the battery life of the device. In an embodiment, the significance threshold may be a predetermined threshold, may set by the user, or may be changed dynamically. At 407, if the pupillary differentiation exceeds the significance threshold, then the brightness of the display may be adjusted to a second setting.

In an embodiment, the foregoing methods may be applied to virtual reality and augmented reality goggles. When in use, these goggles block out nearly all ambient light. A forward facing camera (e.g., an RGB camera) may be placed on the inner portion of the goggles to be able to capture images of a user's pupil. Measuring a user's pupil size while displaying a bright scene followed by a dark scene would provide enough data to properly adjust the brightness of the goggle display based on the user's particular sensitivity to display brightness. In an embodiment, this process requires no user interaction and is performed automatically.

The various embodiments described herein thus represent a technical improvement to conventional methods of adjusting the brightness of a display. Using the techniques described here, an embodiment provides an automated adjustment of display brightness based upon the measurement of a user's pupil size. Using this measure, more accurate brightness settings may be achieved for all users in all conditions.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

capturing, using a camera on a device, a first image and a second image of a user viewing a display of the device, wherein the second image is captured after the first image;

determining, using a processor, a pupil size of the user in the first image and the second image;

determining a pupillary differentiation between the first image and the second image;

determining, based on the pupillary differentiation and with reference to a display brightness data table, a projected display brightness differential, the display brightness data table comprising predetermined display brightness settings corresponding to each pupil size;

responsive to identifying that the projected display brightness differential exceeds a predetermined threshold, adjusting, using a processor, a brightness setting of the display from an existing brightness setting to another brightness setting; and responsive to identifying that the projected display brightness differential does not exceed the predetermined threshold, maintaining the existing brightness setting.

2. The method of claim 1, wherein the capturing comprises changing the frequency that the second image is captured in relation to the first image.

3. The method of claim 1, wherein the capturing comprises actively transmitting light from the device and receiving reflections therefrom.

4. The method of claim 1, further comprising maintaining the existing brightness setting if the projected display brightness differential does not exceed the predetermined threshold.

5. The method of claim 1, wherein the pupil size is determined from a pupil dimension.

6. The method of claim 1, further comprising capturing the first and second image of the pupil when light data associated with an ambient light sensor (ALS) is received.

7. The method of claim 6, wherein an output of the ALS is used to adjust the brightness setting.

8. The method of claim 1, wherein the projected display brightness differential corresponds to a projected value of brightness adjustment of the display from the existing brightness setting to the another brightness setting.

9. An electronic device, comprising:

a camera;

a processor;

a memory device that stores instructions executable by the processor to:

capture, using the camera, a first image and a second image of a user viewing a display of the device, wherein the second image is captured after the first image;

determine a pupil size of the user in the first image and the second image;

determine a pupillary differentiation between the first image and the second image;

determine, based on the pupillary differentiation and with reference to a display brightness data table, a projected display brightness differential, the display brightness data table comprising predetermined display brightness settings corresponding to each pupil size;

responsive to identifying that the projected display brightness differential exceeds a predetermined threshold, adjust a brightness setting of the display from an existing brightness setting to another brightness setting; and responsive to identifying that the projected display brightness differential does not exceed the predetermined threshold, maintain the existing brightness setting.

10. The electronic device of claim 9, wherein the instructions that are executable by the processor to capture comprise instructions that change the frequency that the second image is captured in relation to the first image.

11. The electronic device of claim 9, wherein the instructions that are executable by the processor to capture comprise instructions that actively transmit light from the device and receive reflections therefrom.

12. The electronic device of claim 9, further comprising instructions that are executable by the processor to maintain the existing brightness setting if the in pupil size projected display brightness differential does not exceed the predetermined threshold.

13. The electronic device of claim 9, wherein the pupil size is determined from a pupil dimension.

14. The electronic device of claim 9, further comprising instructions that are executable by the processor to capture the first and second image of the pupil when light data associated with an ambient light sensor (ALS) is received, wherein an output of the ALS is used to adjust the brightness setting.

15. A product, comprising:

a processor;

a storage device that stores code executable by the processor, the code comprising:

code that captures a first image and a second image of a user viewing a display of the device, wherein the second image is captured after the first image;

code that determines a pupil size of the user in the first image and the second image;

code that determines a pupillary differentiation between the first image and the second image;

code that determines, based on the pupillary differentiation and with reference to a display brightness data table, a projected display brightness differential, the display brightness data table comprising predetermined display brightness settings corresponding to each pupil size;

code that adjusts, responsive to identifying that the projected display brightness differential exceeds a predetermined threshold, a brightness setting of the display from an existing brightness setting to another brightness setting; and code that maintains, responsive to identifying that the projected display brightness differential does not exceed the predetermined threshold, the existing brightness setting.

16. The electronic device of claim 9, wherein the projected display brightness differential corresponds to a projected value of brightness adjustment of the display from the existing brightness setting to the another brightness setting.

* * * * *